US006603949B2

(12) United States Patent
Itoh et al.

(10) Patent No.: US 6,603,949 B2
(45) Date of Patent: Aug. 5, 2003

(54) APPARATUS AND METHOD FOR CONTROLLING THE FORMATION OF AN IMAGE WITH RECOVERED AND NEW TONER

(75) Inventors: Shinichi Itoh, Yokohama (JP); Tetsuo Katoh, Kunitachi (JP); Tatsuyuki Miura, Yokohama (JP); Seiji Tsuzuki, Kawaguchi (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/975,975

(22) Filed: Oct. 15, 2001

(65) Prior Publication Data

US 2003/0072580 A1 Apr. 17, 2003

(51) Int. Cl.[7] ..... G03G 21/10; G03G 15/10; G03G 15/08

(52) U.S. Cl. ..... 399/359; 399/62; 399/258

(58) Field of Search ..... 399/61, 62, 258, 399/262, 263, 358, 359, 360

(56) References Cited

U.S. PATENT DOCUMENTS 4,260,073 A * 4/1981 Baumann ..... 399/359 X
5,493,382 A * 2/1996 Takagaki et al. ..... 399/359
6,192,212 B1 * 2/2001 Kunihiro et al. ..... 399/359 X

FOREIGN PATENT DOCUMENTS

JP 2000-267366 9/2000

* cited by examiner

*Primary Examiner*—Sandra Brase
(74) *Attorney, Agent, or Firm*—Foley & Lardner

(57) ABSTRACT

An image forming apparatus and method causes a connecting/conveying device to convey a recovered toner from a cleaner part to a recovered toner housing unit to house therein the recovered toner. A controller controls a recovered toner supply unit and new toner supply unit in accordance with a toner concentration ratio in a developing device, which is detected by toner concentration ratio detecting unit, to supply the recovered toner, which is stored in the recovered toner housing unit, and a new toner, which is stored in new toner housing unit, to the developing device. The controller causes the amount of the recovered toner to be supplied to be less than the amount of the recovered toner during a usual operation, which is determined in accordance with the contents detected by the toner concentration ratio detecting unit, or stops the supply of the recovered toner, while a predetermined period condition is satisfied after the occurrence of a predetermined event in which the amount of the recovered toner stored in the recovered toner housing unit is temporarily excessive.

8 Claims, 11 Drawing Sheets

APPARATUS AND METHOD FOR CONTROLLING THE FORMATION OF AN IMAGE WITH RECOVERED AND NEW TONER

TECHNICAL BACKGROUND

The present invention generally relates to an apparatus and method for forming an image, and is capable of being applied to an image forming apparatus and method, which utilize toner of a copying machine or printer having a photosensitive drum.

In an image forming apparatus and method utilizing toner, there is carried out an image forming process for electrifying minus charges on the surface of a photosensitive drum, exposing (varying the surface potential of) the photosensitive drum to laser beams based on picture signals to form a latent image, causing it to absorb minus charged toner to form a visible image, and transferring and fixing the visible image on a paper.

In such image formation, a toner (which will be hereinafter referred to as a "recovered toner") which has been already utilized in image formation, and a toner (which will be hereinafter referred to as a "new toner") which has not yet been utilized in image formation, are mixed to be utilized. That is, the recovered toner is recycled to be used.

Conventionally, as a method for recycling a recovered toner, there is a method for conveying a recovered toner, which leaves a cleaner auger, to a developing device by means of a connecting auger, which connects the cleaner auger to the developing device, and returning the recovered toner directly into the developing device.

In this method, the rotation of the cleaner auger must be in synchronism with the rotation of the photosensitive drum, and the rotation of the connecting auger to the developing device must be connected with the cleaner auger. In some operation modes, these conditions are not satisfied, so that the recovered toner recovered by the cleaner is fixed to components and so forth in the cleaner auger and/or connecting auger without being fed.

If the body cover of the coping machine or printer is open and closed in such a state, the large amount of the recovered toner fixed to the auger(s) and/or the inner walls of pipes in the cleaner and/or connecting auger are conveyed into the developing device at a time by vibrations occurring during the opening/closing of the cover. For that reason, the developer toner specific concentration is temporarily in a high state (an excessive toner state), so that image fogging occurs on an image transferred to a paper.

That is, an external additive is peeled from the recovered toner, and paper powder is mixed in the recovered toner. Therefore, even if the recovered toner is supplied into the developing device, the rise of the quantity of electrification is worse than that in the case of the new toner, and if the percentage of the recovered toner increases, image fogging is easy to occur.

Also, during adjustment for carrying out initialization after exchanging the developer on the basis of the toner empty display when the new toner is completely consumed, the supply of the recovered toner from the cleaner part to the developing device continues, so that the percentage of the recovered toner in the developing device increases. Also in this case, as described above, the developer toner specific concentration is in the high state (the excessive toner state), so that image fogging occurs on an image transferred to a paper.

SUMMARY OF THE INVENTION

It is an object of the present invention to prevent conventional bad influences which are caused when a recovered toner is excessively supplied into a developing device.

In order to accomplish the aforementioned object, according to the present invention, an image forming apparatus comprises: recovered toner housing means for temporarily storing therein a recovered toner; a connecting/conveying device for conveying the recovered toner from a cleaner part to the recovered toner housing means; recovered toner supply means for supplying the recovered toner, which is housed in the recovered toner housing means, to a developing device; new toner housing means for housing therein a new toner; new toner supply means for supplying the new toner, which is stored in the new toner housing means, to the developing device; toner concentration ratio detecting means for detecting a toner concentration ratio in the developing device; and control means for controlling the recovered toner supply means and the new toner supply means in accordance with the contents detected by the toner concentration ratio detecting means, to supply the recovered toner and new toner to the developing device, wherein the control means causes the amount of the recovered toner to be supplied to be less than the amount of the recovered toner during a usual operation, which is determined in accordance with the contents detected by the toner concentration ratio detecting means, or stops the supply of the recovered toner, while a predetermined period condition is satisfied after the occurrence of a predetermined event in which the amount of the recovered toner stored in the recovered toner housing means is temporarily excessive.

In order to accomplish the aforementioned object, according to the present invention, there is provided an image forming method for causing a connecting/conveying device to convey a recovered toner from a cleaner part to recovered toner housing means to house therein the recovered toner, and causing control means to control recovered toner supply means and new toner supply means in accordance with a toner concentration ratio in a developing device, which is detected by toner concentration ratio detecting means, to supply the recovered toner, which is stored in the recovered toner housing means, and a new toner, which is stored in new toner housing means, to the developing device, wherein the control means causes the amount of the recovered toner to be supplied to be less than the amount of the recovered toner during a usual operation, which is determined in accordance with the contents detected by the toner concentration ratio detecting means, or stops the supply of the recovered toner, while a predetermined period condition is satisfied after the occurrence of a predetermined event in which the amount of the recovered toner stored in the recovered toner housing means is temporarily excessive.

BEST MODE FOR CARRYING OUT THE INVENTION

The preferred embodiment of an image forming apparatus and method utilizing toner according to the present invention will be described below. In the following description, it is assumed that a copying machine is provided with a preferred embodiment of an image forming apparatus according to the present invention.

The image forming apparatus is incorporated in a copying machine for forming and transferring an image on a paper by the reversal development system on the basis of the original to be copied.

Figure 1:
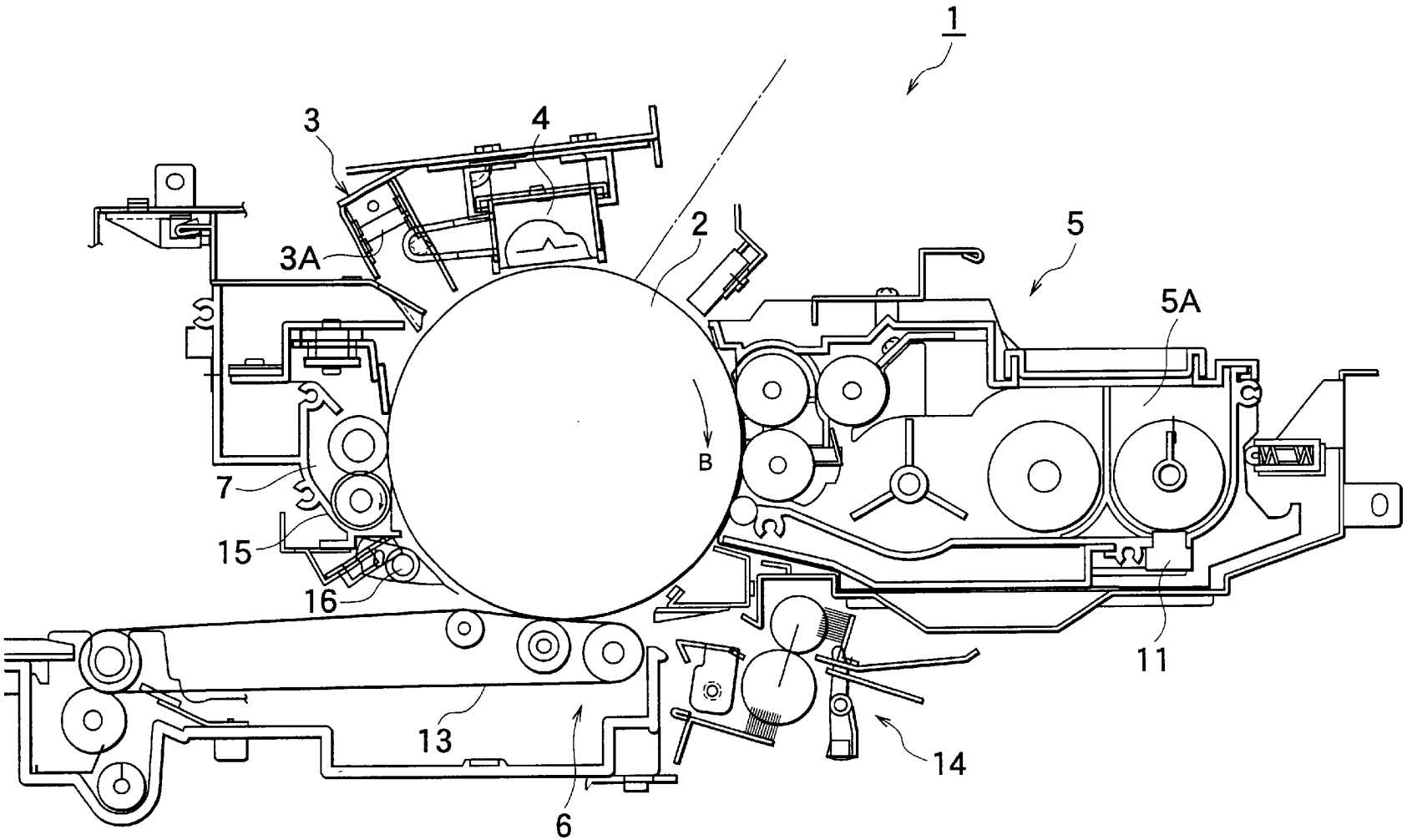
FIG. 1 is a schematic front view showing a principal part of a preferred embodiment of an image forming apparatus according to the present invention.
Figure 2:
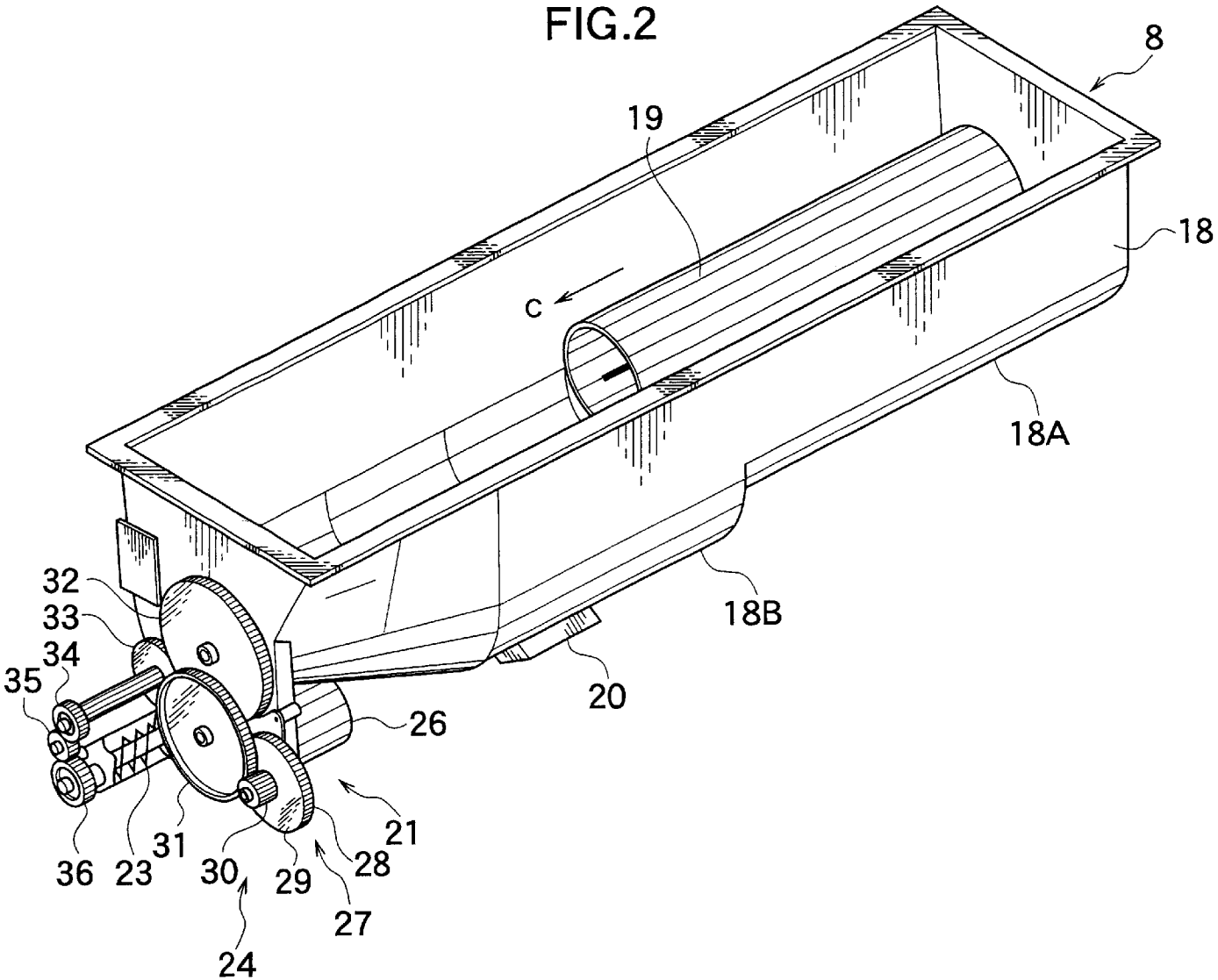
FIG. 2 is a perspective view of a preferred embodiment of a new toner supply device according to the present invention.
Figure 3:
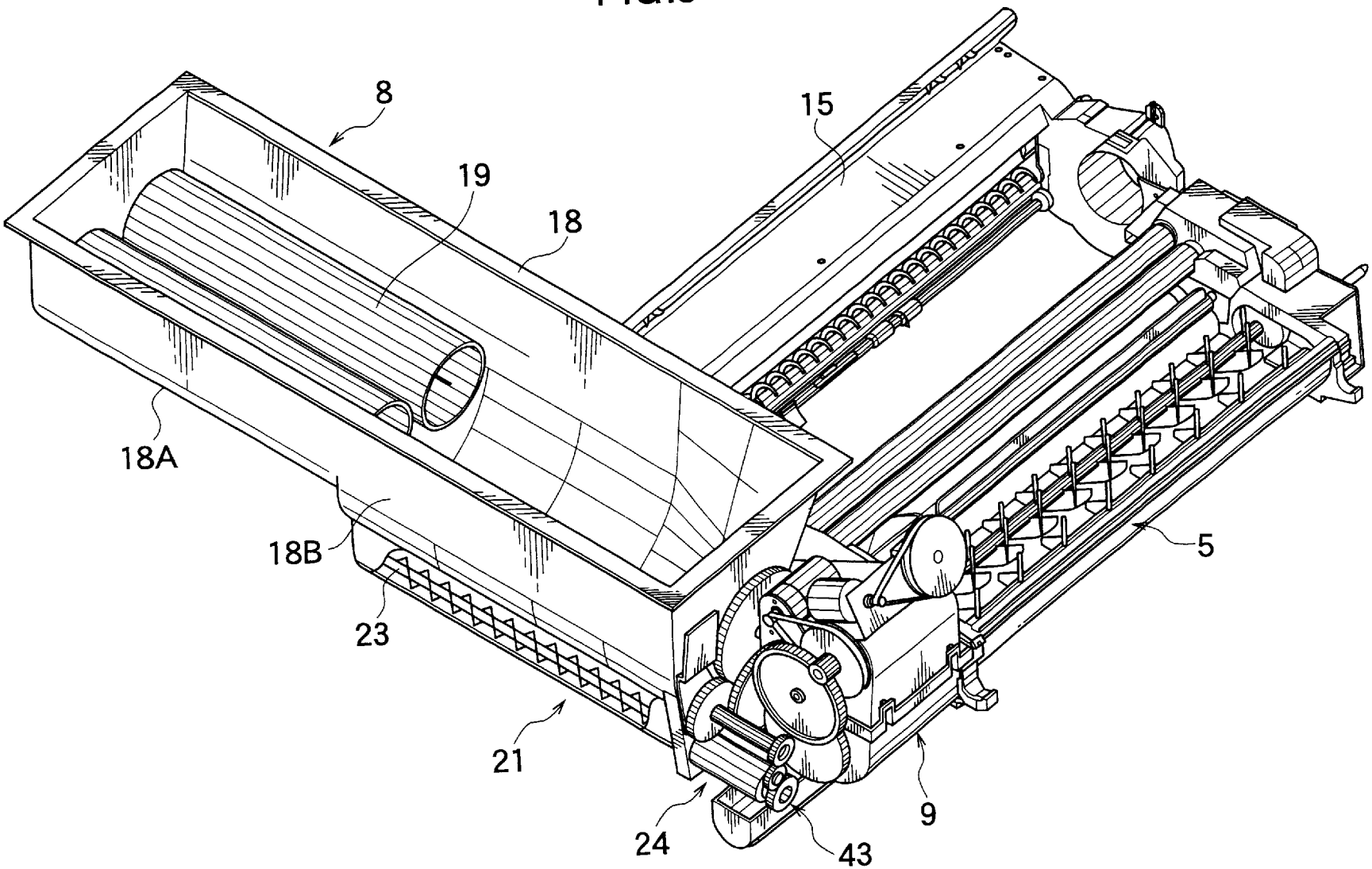
FIG. 3 is a perspective view of the image forming apparatus in the preferred embodiment.
Figure 4:
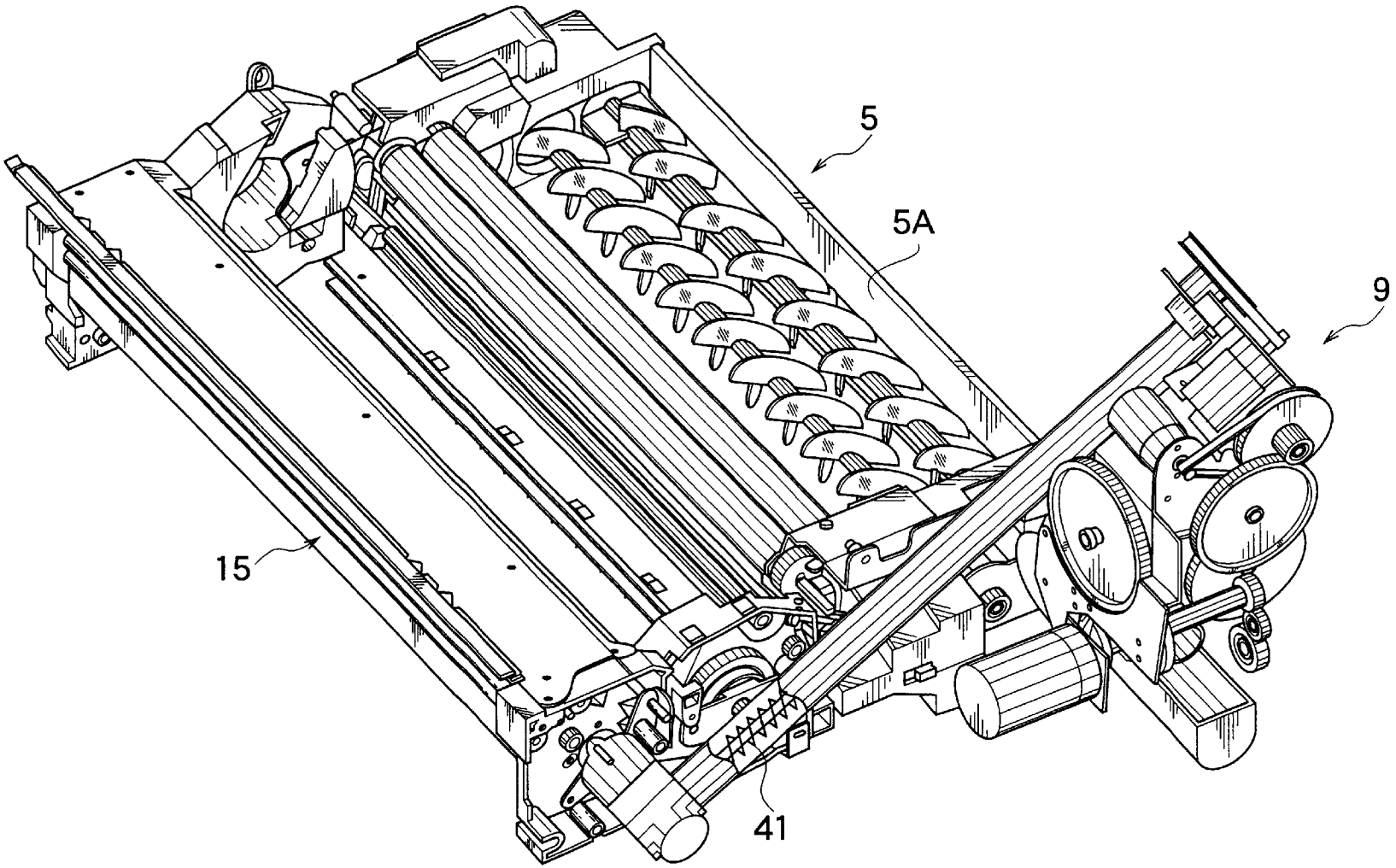
FIG. 4 is a perspective view of the image forming apparatus in the preferred embodiment, from which the new toner supply device is removed.
Figure 5:
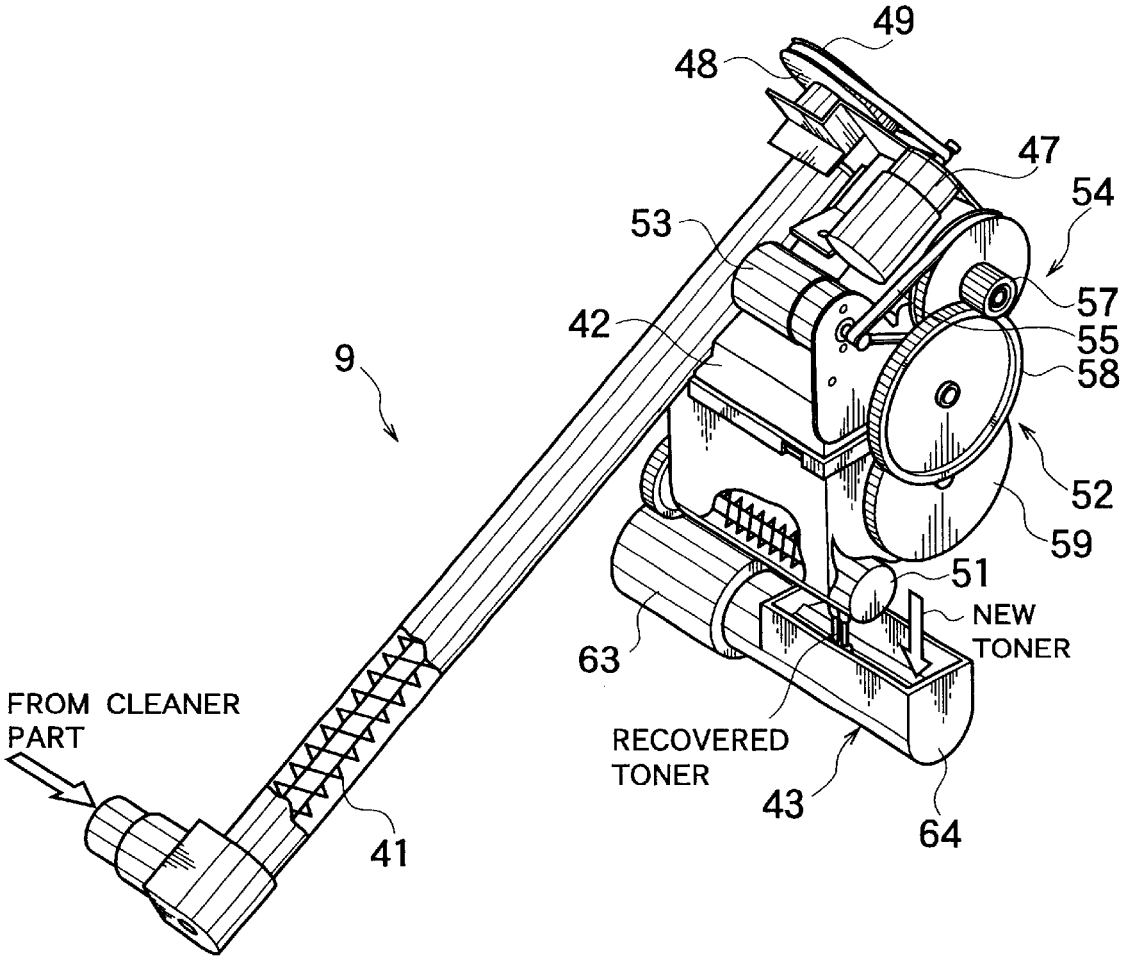
FIG. 5 is a perspective view of a preferred embodiment of a recovered toner supply device according to the present invention.
Figure 6:
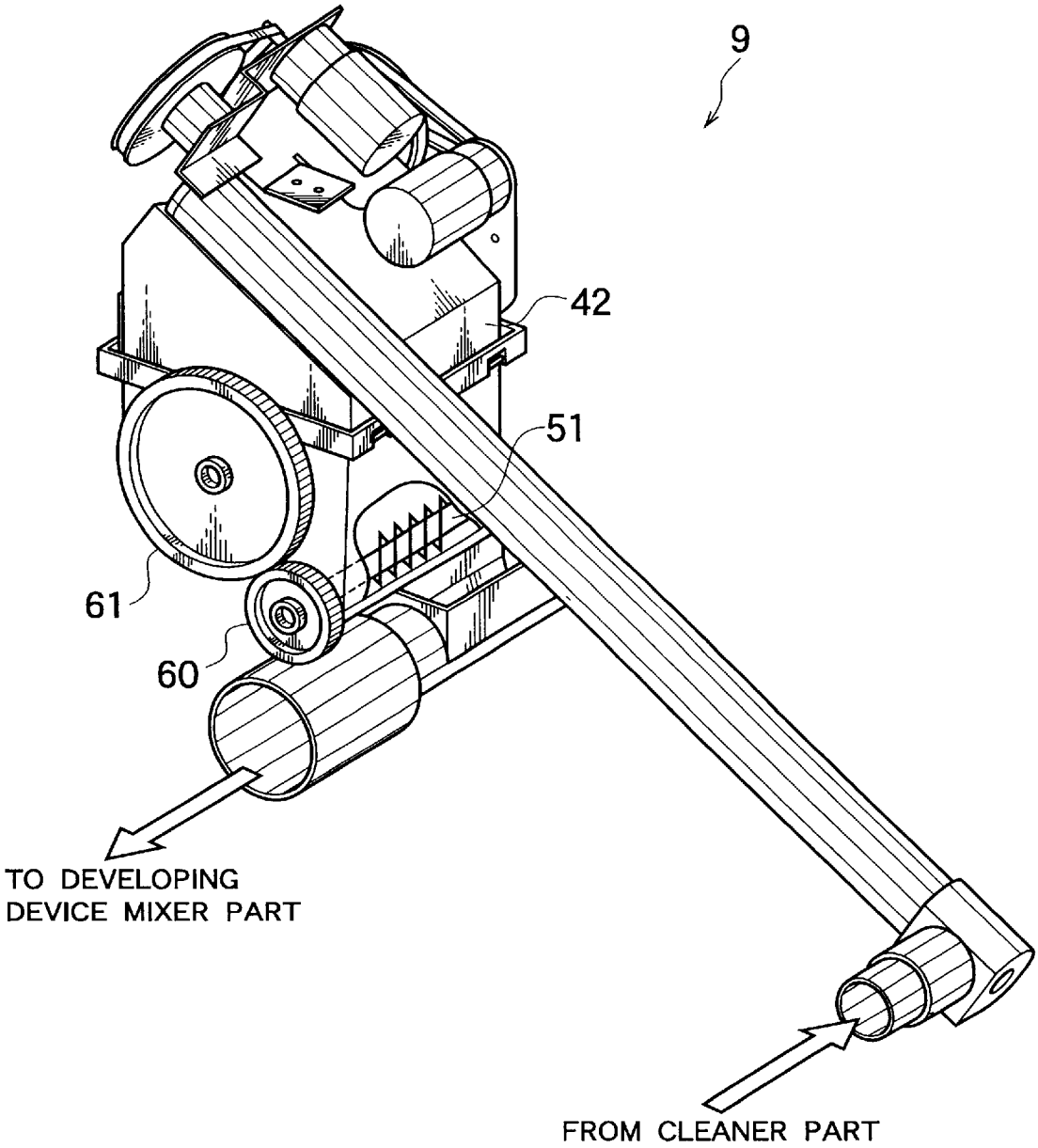
FIG. 6 is a perspective view of the recovered toner supply device in the preferred embodiment, which is viewed from a view point different from that in FIG. 5.

Referring now to FIGS. 1 through 3, the whole construction of this image forming apparatus will be described below.

The image forming apparatus 1 mainly comprises a photosensitive drum 2, a de-electrifying part 3, an electrifying charger 4, a developing device 5, a transfer part 6, a cleaner part 7, a new toner supply device 8 and a recovered toner conveying device 9.

The photosensitive drum 2 is a cylindrical drum which is designed to rotate in one direction (clockwise in FIG. 1, i.e., in a direction of arrow B). The charged state on the surface of the photosensitive drum 2 is capable of being optionally adjusted by laser beams. Thus, by suitably adjusting the charged state of an optional portion on the surface of the photosensitive drum 2, an image or the like serving as data to be transferred can be formed on the surface of the photosensitive drum 2 as a latent image.

The de-electrifying part 3 is provided for removing electrification on the surface of the photosensitive drum 2. The de-electrifying part 3 comprises a de-electrifying lamp 3A. By exposing the surface of the photosensitive drum 2 to the light of the de-electrifying lamp 3A, all of residual electric charges on the surface are removed to prepare for the next print.

The electrifying charger 4 is provided for charging the surface of the photosensitive drum 2. The surface of the photosensitive drum 2 negatively charged by the electrifying charger 4 is exposed to laser beams, which are emitted from a laser unit (not shown), to form a latent image. That is, the surface of the photosensitive drum 2 is exposed to laser beams on the basis of input information, such as an original image, so that the surface potential approaches zero in accordance with the concentration of the image or the like to form a latent image.

The developing device 5 is provided for causing an appropriate amount of toner to adhere to the surface of the charged photosensitive drum 2. Since a two-component developing system is herein adopted, the developing device 5 houses therein a carrier and a toner, the percentage of which is adjusted so as to be about 5% (% by weight) with respect to about 95% (% by weight) carrier. Specifically, the new toner supply device 8 and the recovered toner conveying device 9 are suitably controlled to adjust the percentages of the carrier and toner. The amount of the toner in the developing device 5 is always monitored by an auto toner sensor 11. If the percentage of the toner in the developing device 5 is less than 5%,the new toner supply device 8 and the recovered toner conveying device 9 are suitably controlled by a control part 70, which will be described later, to supply a required amount of toner. The supplied toner and carrier are stirred by a mixer part 5A in the developing device 5, so that negative charges are given to the toner by the frictional electrification during stirring. The negatively charged toner is absorbed onto the latent image on the surface of the photosensitive drum 2 to form a visible image.

The transfer part 6 is provided for transferring the toner, which is absorbed onto the latent image on the surface of the photosensitive drum 2, to a paper. The transfer part 6 mainly comprises a transfer belt 13 and a paper feeding part 14. The transfer belt 13 is designed to support thereon and convey a paper to cause the paper to contact the surface of the photosensitive drum 2 to transfer the visible image to the paper. The paper feeding part 14 is arranged so as to face a contact portion in which the transfer belt 13 contacts the photosensitive drum 2. The paper fed from the paper feeding part 14 to the contact portion in which the transfer belt 13 contacts the photosensitive drum 2 is positively charged to absorb the negatively charged toner which is used for forming the visible image. The paper to which the toner is transferred is fed to a fixing device (not shown) by which the toner is fixed to the paper.

The cleaner part 7 is provided for cleaning the surface of the photosensitive drum 2. The cleaner part 7 is designed to remove the toner remaining on the surface of the photosensitive drum 2 after the toner is transferred to the paper by the transfer part 6. The cleaner part 7 comprises a toner receiving part 15 and a discharging auger 16, in order to discharge the toner, which is removed from the surface of the photosensitive drum 2, to the outside. The toner removed from the surface of the photosensitive drum 2 falls to the toner receiving part 15 to be discharged toward the recovered toner conveying device 9 by means of the discharging auger 16.

The new toner supply device 8 is a device for supplying a new toner to the developing device 5. As shown in FIGS. 2 and 3, the new toner supply device 8 is arranged so as to extend in a direction perpendicular to the developing device 5. In this state, the new toner supply device 8 is installed on the front side of the body of the copying machine. The new toner supply device 8 comprises a toner housing container part 18, two stirring/conveying paddles 19, a toner residual amount detecting sensor 20 and a conveying part 21.

The toner housing container part (new toner hopper) 18 is a container for storing therein a new toner. The toner housing container part 18 comprises a substantially semi-cylindrical container, the upper side of which is open. The semi-cylindrical toner housing container part 18 is divided into a shallow-bottom portion 18A and a deep-bottom portion 18B at the center thereof in longitudinal directions. In the shallow-bottom portion 18A, the two stirring/conveying paddles 19 are provided so as to extend in parallel to each other. The deep-bottom portion 18B is provided with the toner residual amount detecting sensor 20 and the conveying part 21.

The stirring/conveying paddles 19 constitute a device for conveying the new toner, which is stored in the toner housing container part 18, to the conveying part 21 while stirring the new toner. As described above, the stirring/conveying paddles 19 are provided in the shallow-bottom portion 18A of the toner housing container part 18 so as to extend in parallel to each other. If the two stirring/conveying paddles 19 rotate, the new toner in the toner housing container part 18 is transferred to the conveying part 21 of the deep-bottom portion 18B. Each of the stirring/conveying paddles 19 is driven by a drive unit (not shown).

The toner residual amount detecting sensor 20 is a sensor for detecting the residual amount of the new toner which is stored in the toner housing container part 18. The residual amount of the new toner is always detected by the toner residual amount detecting sensor 20, since it is not possible to carry out image formation if the toner is completely consumed. As the toner residual amount detecting sensor 20, a well-known sensor, such as a magnetic sensor or an optical sensor, may be used.

The conveying part 21 is provided for supplying the new toner, which is stored in the toner housing container part 18, to the developing device 5. The conveying part 21 comprises a toner conveying auger 23 and an auger driving part 24. The toner conveying auger 23 is a screw conveyer which is provided on the bottom of the deep-bottom portion 18B so as to extend in parallel to the toner housing container part 18. The toner conveying auger 23 is arranged so as to face a toner pan part 64, which will be described later, and is designed to supply the new toner which is stored in the toner housing container part 18. The auger driving part 24 comprises a drive motor (which will be hereinafter referred to as a "toner hopper motor") 26, and a reduction gear 27. The toner hopper motor 26 comprises, e.g., a stepping motor. By controlling the rotating amount and rotating time of the toner conveying auger 23 by the toner hopper motor 26, the amount of the new toner to be supplied is precisely controlled. The reduction gear 27 comprises a belt 28, a pulley 29 and gears 30 through 36. The gears 30 through 36 are suitably adjusted in accordance with reduction ratios. On the rotation shaft of the gear 32, a stirring rod (not shown) provided on the deep-bottom portion 18B is mounted.

The recovered toner conveying device 9 is provided for conveying the recovered toner, which is recovered by the cleaner part 7, to the developing device 5 to recycle the recovered toner therein. The recovered toner conveying device 9 is arranged below the new toner supply device 8 so as to substantially extend in parallel thereto. As shown in FIGS. 3 through 6, the recovered toner conveying device 9 comprises a recovered toner connecting/conveying auger 41, a recovered toner sub-hopper 42 and a supply auger 43.

The recovered toner connecting/conveying auger 41 is provided for conveying the recovered toner, which is recovered by the cleaner part 7, toward the developing device 5. The recovered toner connecting/conveying auger 41 comprises, e.g., a long screw conveyer. The bottom end portion of the recovered toner connecting/conveying auger 41 is connected to the discharging auger 16 of the cleaner part 7, and the top end portion thereof is connected to the recovered toner sub-hopper 42. The driving part 45 of the recovered toner connecting/conveying auger 41 comprises a drive motor 47 which is provided adjacent to the top end portion of the recovered toner connecting/conveying auger 41, a pulley 48 which is connected to the recovered toner connecting/conveying auger 41, and a belt 49 which connects the drive motor 47 to the pulley 48. The drive motor 47 is controlled so as to be connected with the drive motor of the discharging auger 16.

The recovered toner sub-hopper 42 is a container for temporarily storing the recovered toner, which is recovered by the recovered toner connecting/conveying auger 41, to feed the required amount of the recovered toner to the developing device 5. In the recovered toner sub-hopper 42, there is provided a stirring rod (not shown) for stirring the recovered toner which is stored therein. In the lower portion in the recovered toner sub-hopper 42, a recovered toner supply auger 51 is provided. The rotation of the recovered toner supply auger 51 is controlled by a driving part 52, so that the recovered toner supply auger 51 is designed to supply a precise amount of recovered toner to the supply auger 43. The driving part 52 comprises a drive motor 53 and a reduction gear 54. The drive motor 53 comprises, e.g., a stepping motor. The reduction gear 54 comprises a belt 55, a pulley 56 and gears 57 through 61 which are combined with each other. The gears 59 and 60 are provided on both sides of the recovered toner sub-hopper 42 to be connected to each other by means of a single rotation shaft which is provided with a stirring rod (not shown).

The supply auger 43 is provided for receiving the recovered toner and the new toner from the recovered toner supply auger 51 and the toner conveying auger 23 of the new toner supply device 8, respectively, to supply them into the developing device 5. The supply auger 43 comprises an auger part 63 which is provided so as to extend from the mixer part 5A of the developing device 5, and a toner pan part 64 which is open to the recovered toner supply auger 51 and the toner conveying auger 23. The drive motor (not shown) of the auger part 63 is provided on the side of the developing device 5. The recovered toner supply auger 51 is provided on the side of the developing device 5. In the toner pan part 64, the new toner from the toner conveying auger 23 of the new toner supply device 8 is supplied upstream of the recovered toner from the recovered toner supply auger 51.

Figure 7:
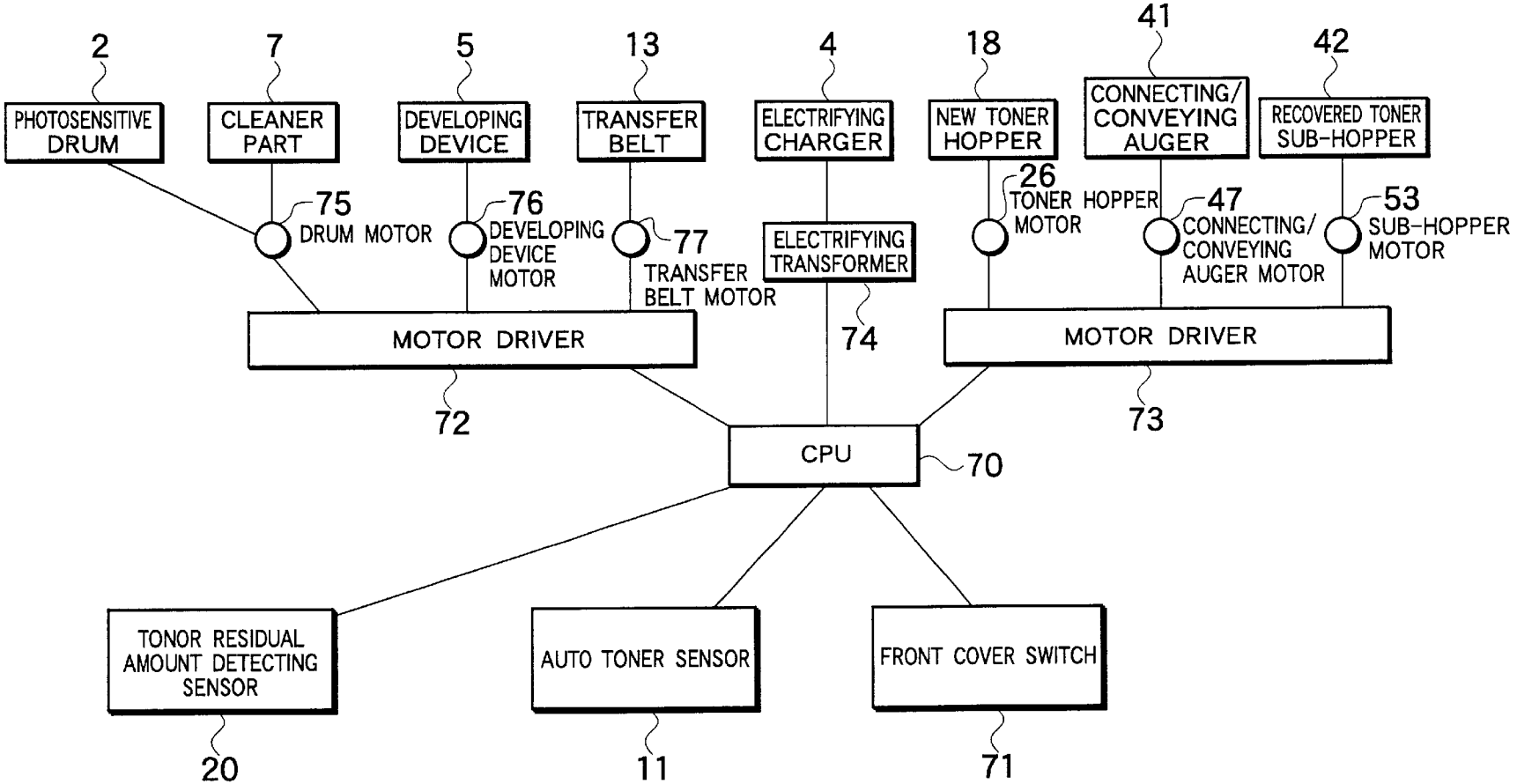
FIG. 7 is a block diagram showing the control construction of the image forming apparatus in the preferred embodiment.

FIG. 7 is a block diagram showing the control construction of the image forming apparatus 1 in this preferred embodiment.

A control part (shown by CPU in FIG. 7) 70 comprises, e.g., a CPU, ROM and RAM, and is designed to control the whole image forming apparatus 1 on the basis of a processing program, which is stored in the ROM and RAM, and in accordance with data and the outputs of various sensors, which are stored in the ROM and RAM.

The input port of the control part 70 is connected to the above described toner residual amount detecting sensor 20 and auto toner sensor 11, and to a front cover switch 71.

As described above, the toner residual amount detecting sensor 20 is designed to detect the residual amount of the new toner in the new toner hopper 18. For example, as the toner residual amount detecting sensor 20, a magnetic sensor comprising a magnet and a reed switch may be used. When the residual amount of the new toner is large, the new toner enters between the magnet and the reed switch to form a gap therebetween to turn the reed switch off. On the other hand, when the residual amount of the new toner is small, the gap disappears, so that the reed switch is turned on by the attraction of the magnet. Such on/off of the reed switch is detected by the control part 70.

As described above, the auto toner sensor 11 is a toner concentration ratio sensor for detecting the ratio of the carrier (iron) to the toner (resin) in the developer. The output of the auto toner sensor 11 is read by the control part 70. If the concentration of the toner decreases, the control part 70 is designed to drive the toner hopper motor 26 and so forth to supply the toner to the developing device 5, and to display no toner on a control panel (not shown) to inform the user of it.

The front cover switch 71 is a switch which is turned off/on by the opening/closing of a body cover (which is herein assumed as a front cover) of the copying machine. The control part 70 reads the output signal of the front cover switch 71 to recognize the state of the front cover.

The output port of the control part 70 is connected to two motor drivers 72, 73 and an electrifying transformer 74.

The photosensitive drum 2 and the cleaner part 7 are driven by the drum motor 75, which is rotated by a motor driver 72, under the control of the control part 70 during a copying operation or the like.

Similarly, the developing device 5 and the transfer belt 13 are driven by a developing device motor 76 and a transfer belt motor 77, respectively, which are rotated by the motor driver 72, under the control of the control part 70 during a copying operation or the like.

Similarly, the new toner hopper 18, the connecting/conveying auger 41 and the recovered toner sub-hopper 42 are driven by the toner hopper motor 26, the connecting/conveying auger motor 47 and the sub-hopper motor 53, respectively, which are rotated by the motor driver 73.

Furthermore, although the toner hopper motor 26, the connecting/conveying auger motor 47 and the sub-hopper motor 53 are connected to the same motor driver 73, these motors can be separately driven by the control of the control part 70.

As described above, during a copying operation or the like, a high voltage is applied to the electrifying charger 4 by the electrifying transformer 74 under the control of the control part 70, so that the electrifying charger 4 electrifies the photosensitive drum 2.

Referring to the flow chart of FIG. 8, the schematic image forming operation (image forming method) in the image forming apparatus in this preferred embodiment will be described below.

Figure 8:
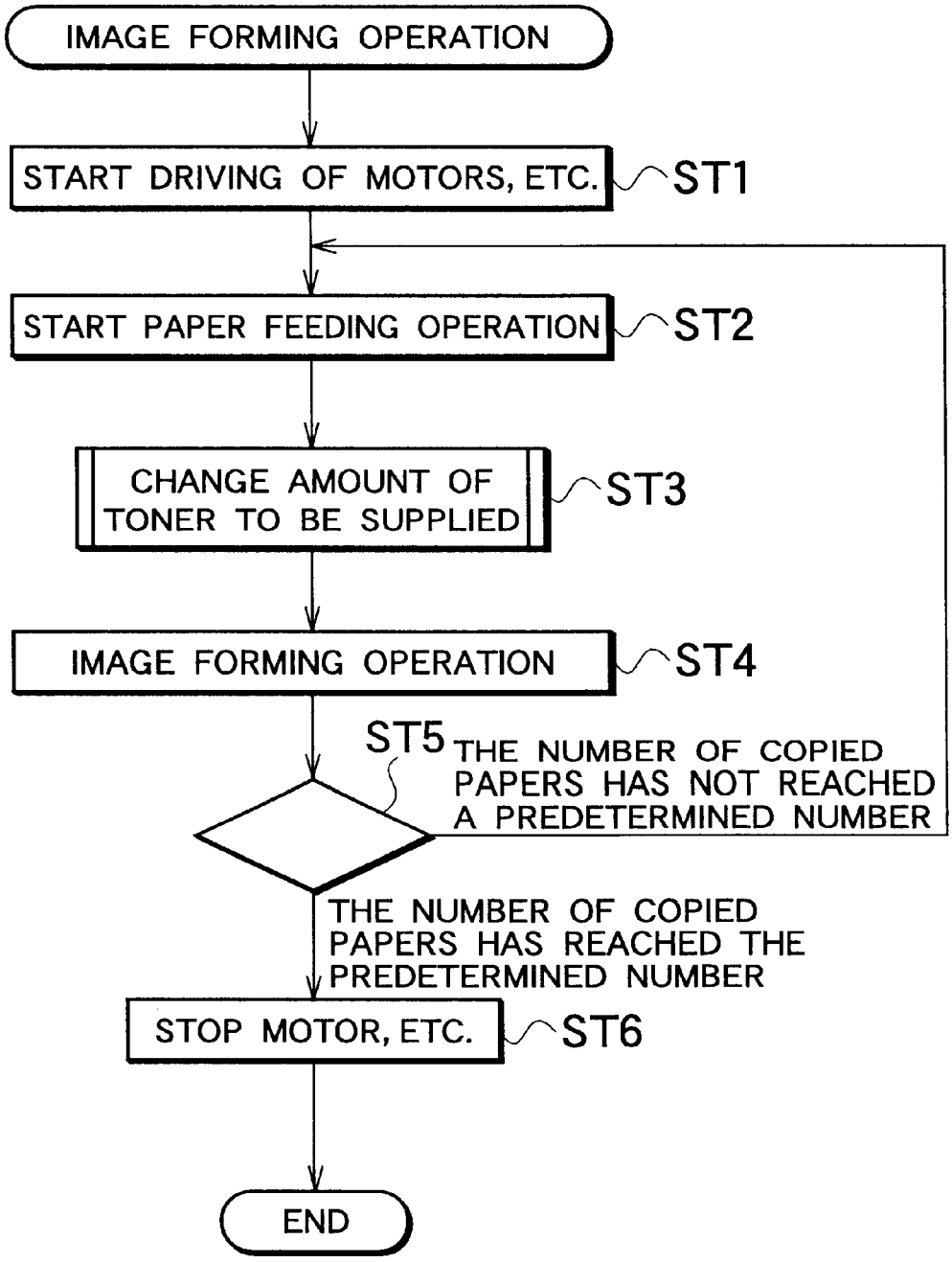
FIG. 8 is a flow chart showing an image forming operation in the preferred embodiment of an image forming apparatus according to the present invention.

In FIG. 8, if a copying operation (image forming operation) is started by a keying part (not shown), the control part 70 carries out a drive starting process for various motors (ST1).

Figure 9:
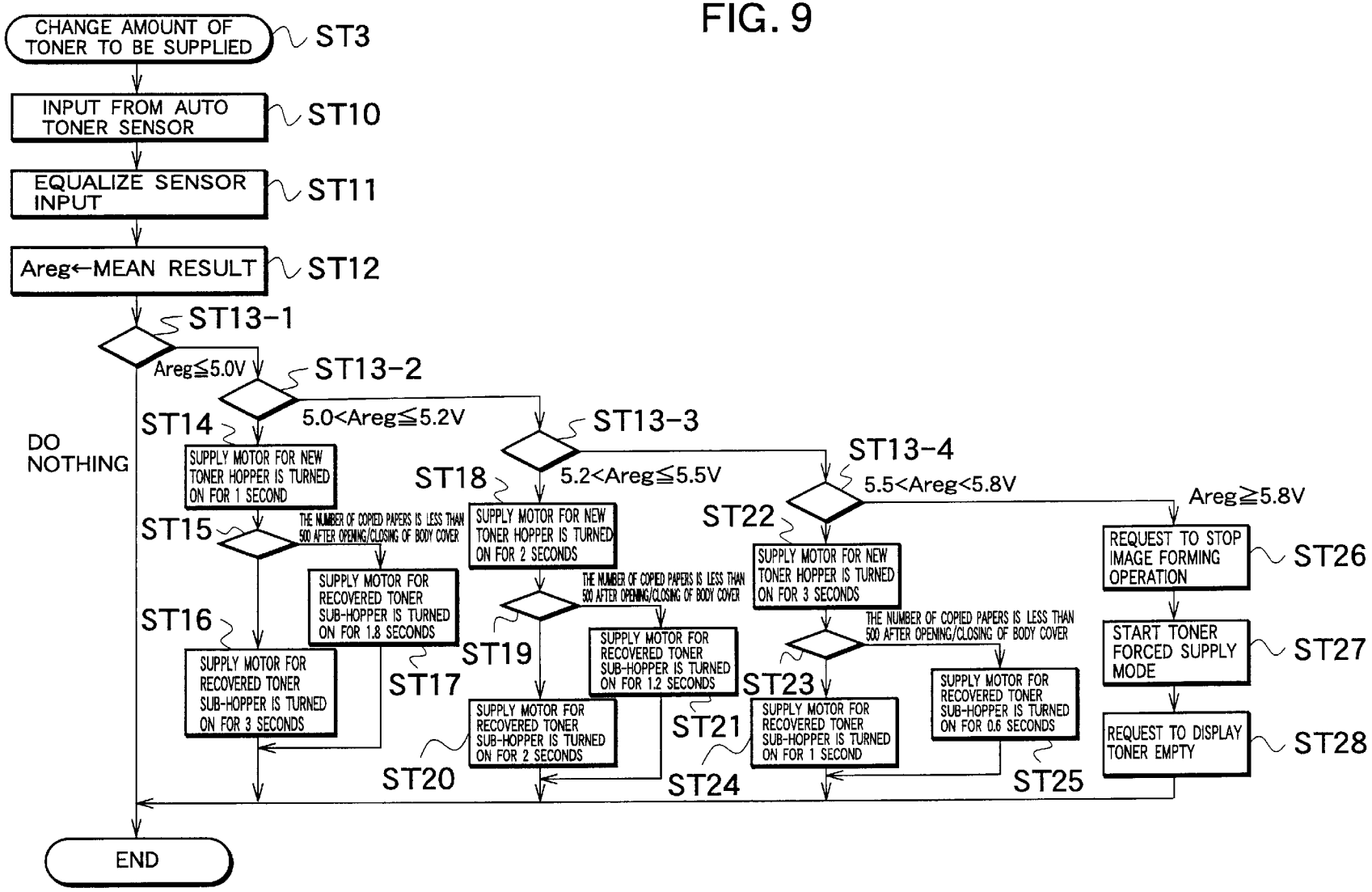
FIG. 9 is a flow chart showing a toner supply amount changing control process in FIG. 8, with respect to the process after opening and closing a body cover.

Thereafter, a process for each paper is carried out. That is, the control part 70 causes to start a paper feeding operation (ST2), and carries out a toner supply amount changing control (ST3), the details of which are shown in FIG. 9 (and FIG. 11). Then, the control part 70 causes to execute a concrete image forming operation (ST4).

After such a process for each paper is completed, the control part 70 determines whether the number of copied papers reaches a predetermined number (ST5). If the number of copied papers has not reached the predetermined number, the routine returns to the above described step ST2. On the other hand, if the number of copied papers has reached the predetermined number, the control part 70 causes to execute a stopping process for various motors (ST6).

Referring to the flow chart of FIG. 9, the details of the toner supply amount changing control process at the above described step ST3, which are the features of this preferred embodiment, will be described below. Furthermore, FIG. 9 shows the process with respect to the control of the amount of toner to be supplied after the body cover (front cover) is open and closed.

The new toner has been stored in the new toner hopper 18, and the recovered toner recovered by a cleaner auger part (not shown) has been conveyed by the connecting/conveying auger 41 to be stored in the recovered toner sub-hopper 42.

The toner supply control to the developing device 5 is basically carried out when the toner specific concentration to the developer, which is detected by the auto toner sensor (toner concentration ratio sensor) 11 provided in relation to the developing device 5, is less than a reference concentration.

In the toner supply amount changing control process shown in FIG. 9, the control part 70 first inputs an output voltage from the auto toner sensor 11 (ST10), to equalize the inputted voltage in order to remove the influence of noises and so forth (ST11), and sets the mean result as a toner concentration ratio parameter Areg (ST12).

Furthermore, in the following descriptions, it is assumed that the output voltage of the auto toner sensor 11 increases as the toner concentration ratio decreases. It is also assumed that the new toner hopper 18 and the recovered toner sub-hopper 42 have the same supply capacity when being driven for the same period of time, as will be described later.

If the control part 70 obtains the toner concentration ratio parameter Areg, the control part 70 determines its stage (ST13-1 through ST13-4).

When the toner concentration ratio parameter Areg is 5.0 V or less, i.e., when the toner concentration in the developer is a reference concentration or higher, the control part 70 ends the process shown in FIG. 9 without causing to supply toner from the new toner hopper 18 and recovered toner sub-hopper 42. That is, both of the new toner and the recovered toner are not supplied to the developing device 5.

When the toner concentration ratio parameter Areg is higher than 5.0 V and lower than or equal to 5.2 V, i.e., when the toner concentration in the developer is slightly lower than the reference concentration, the control part 70 first causes the toner hopper motor 26, which causes to supply the new toner in the new toner hopper 18 to the developing device 5, to be turned on only for 1 second to supply the new toner to the developing device 5 (ST14).

Then, the control part 70 determines whether the number of copied papers in the current copying operation is 500 or more after the body cover (front cover) of the copying machine is open and closed immediately before (ST15). If it is 500 or more, the control part 70 causes the sub-hopper motor 53, which causes to supply the recovered toner in the recovered toner sub-hopper 42 to the developing device 5, to be turned on only for 3 seconds to supply the recovered toner to the developing device 5 (ST16). On the other hand, if it is less than 500, the control part 70 causes the sub-hopper motor 53 to be turned on only for 1.8 seconds to supply the recovered toner to the developing device 5 (ST17).

When the toner concentration ratio parameter Areg is higher than 5.2 V and lower than or equal to 5.5 V, i.e., when the toner concentration in the developer is intermediately lower than the reference concentration, the control part 70 first causes the toner hopper motor 26, which causes to supply the new toner in the new toner hopper 18 to the developing device 5, to be turned on only for 2 seconds to supply the new toner to the developing device 5 (ST18).

Then, also in this toner concentration ratio stage, the control part 70 determines whether the number of copied papers in the current copying operation is 500 or more after the body cover (front cover) of the copying machine is open and closed immediately before (ST19). If it is 500 or more, the control part 70 causes the sub-hopper motor 53, which causes to supply the recovered toner in the recovered toner sub-hopper 42 to the developing device 5, to be turned on only for 2 seconds to supply the recovered toner to the developing device 5 (ST20). On the other hand, if it is less than 500, the control part 70 causes the sub-hopper motor 53 to be turned on only for 1.2 seconds to supply the recovered toner to the developing device 5 (ST21).

When the toner concentration ratio parameter Areg is higher than 5.5 V and lower than 5.8 V, i.e., when the toner concentration in the developer is much lower than the reference concentration, the control part 70 first causes the toner hopper motor 26, which causes to supply the new toner in the new toner hopper 18 to the developing device 5, to be turned on only for 3 seconds to supply the new toner to the developing device 5 (ST22).

Then, also in this toner concentration ratio stage, the control part 70 determines whether the number of copied papers in the current copying operation is 500 or more after the body cover (front cover) of the copying machine is open and closed immediately before (ST23). If it is 500 or more, the control part 70 causes the sub-hopper motor 53, which causes to supply the recovered toner in the recovered toner sub-hopper 42 to the developing device 5, to be turned on only for 1 second to supply the recovered toner to the developing device 5 (ST24). On the other hand, if it is less than 500, the control part 70 causes the sub-hopper motor 53 to be turned on only for 0.6 seconds to supply the recovered toner to the developing device 5 (ST51).

When the toner concentration ratio parameter Areg is 5.8 V or more, i.e., when the toner concentration in the developer is such a concentration that the toner can not be utilized for image formation, the control part 70 issues a request to stop the image forming operation to the respective parts (ST26), starts a process in a mode in which the new toner is forced to be supplied (ST27), and requests a display part (not shown) to display a toner empty (ST28).

The reasons why the toner supply amount changing control process is carried out as shown in FIG. 9 will be described below. That is, the reasons why the amount of toner to be supplied is controlled in accordance with the number of copied papers after the body cover is open and closed if the body cover is open and closed will be described below.

As the number of copying operations increases, the amount of consumed toner increases. Therefore, in general, the toner concentration in the developer decreases, and the toner concentration ratio parameter Areg gradually increases. That is, if the new toner in the new toner hopper 18 is completely consumed to decrease the amount of toner to be supplied to the developing device 5, the developer toner specific concentration in the developing device 5 is gradually decreased by the image forming operation, so that the output voltage of the auto toner sensor 11 gradually increases from the reference voltage of 5.0 V. Then, when the toner specific concentration is lower than the reference concentration by about 1% by weight, the output voltage of the auto toner sensor 11 is 5.8 V. This is regarded as the empty state of the new toner. Then, as described above, the toner empty is displayed so that the user can recognize it. Simultaneously, the image forming operation is stopped.

Even before the stage regarded as the empty state of the new toner as described above, the times required to drive the new toner and recovered toner supplying hoppers 18 and 42 are controlled in accordance with the toner concentration ratio to carry out an operation for causing the toner concentration ratio to return to the reference concentration.

In this preferred embodiment, when the body cover (e.g., the front cover) is open and closed for the JAM process or maintenance, the amount of the recovered toner to be supplied, which is determined by the toner specific concentration, is decreased until the number of copied papers after the opening and closing of the body cover reaches a predetermined number.

In conventional systems wherein the recovered toner recovered by the cleaner part 7 is returned directly to the developing device 5 by means of the connecting/conveying auger 41 or the like, if the body cover is open and closed for the JAM process or maintenance, the recovered toner adhering to the connecting/conveying auger 41 and the inner wall of its pipe is peeled off to drop due to vibrations applied thereto, so that the large amount of the recovered toner is temporarily supplied into the developing device 5. That is, a phenomenon wherein a large amount of recovered toner is supplied to the developing device 5 in a short time occurs.

In this preferred embodiment, even if a large amount of recovered toner is temporarily conveyed by the connecting/conveying auger 41 due to vibrations or the like, the recovered toner is stored in the recovered toner sub-hopper 42, so that all of the recovered toner adhering to the connecting/conveying auger 41 and so forth does not enter the developing device 5 at a time.

The conveying capacity of the recovered toner supply auger 51 for conveying the recovered toner from the recovered toner sub-hopper 42 to the supply port of the developing device (developing device mixer extended nozzle 43) is set so as to hold the same capacity as the conveying capacity of the toner conveying auger 23 for the new toner. The reason for this is that although a very small amount of recovered toner is only conveyed to the recovered toner sub-hopper 42, the external additive is peeled from the recovered toner to deteriorate the flowability of toner to easily cause the conveying lock of toner, so that it is required to sufficiently ensure the conveying capacity of the recovered toner supply auger 51 serving as the outlet of the recovered toner sub-hopper 42.

Since the conveying capacity of the recovered toner supply auger 51 is thus set to be sufficiently high, when a large amount of recovered toner temporarily enters the recovered toner sub-hopper 42 due to vibrations during the opening and closing of the body cover, if the supply time from the recovered toner sub-hopper 42 is the same as that during a usual operation (see steps ST16, ST20 and ST24 in FIG. 9), the amount of the recovered toner to be supplied is larger than the amount of the recovered toner to be supplied during the usual operation.

Therefore, in this preferred embodiment, as described above, even if a large amount of recovered toner temporarily enters the recovered toner sub-hopper 42 due to vibrations or the like during the opening and closing of the body cover, the amount of the recovered toner to be supplied from the recovered toner sub-hopper 42 to the developing device 5 is set to be 60% of that during usual operations until 500 image forming operations are carried out after the body cover is open and closed, in order to substantially hold the amount of the recovered toner to be supplied which is substantially equal to that during usual operations (see steps ST17, ST21 and ST25 in FIG. 9).

Specifically, until 500 image forming operations are completed immediately after the control part 70 receives a body cover opening/closing signal from the front cover switch 71 or a JAM process operating signal from an operating part (not shown), the rotating time of the supply auger 51 in the recovered toner sub-hopper 42 is set to be 0.6 times as long as that during usual operations.

Although this set value is an appropriate value in a test apparatus in this preferred embodiment, the rotating time of the supply auger 51 in the recovered toner sub-hopper 42, and the number of image forming operations (the number of copied papers or the number of passed papers) for suppressing the amount of recovered toner to be supplied, may be set on the basis of the amount of recovered toner temporarily conveyed to the recovered toner sub-hopper 42 due to vibrations, the conveying capacity from the recovered toner sub-hopper 42, and the time required to substantially discharge the recovered toner temporarily stored in the recovered toner sub-hopper 42.

Figure 10:
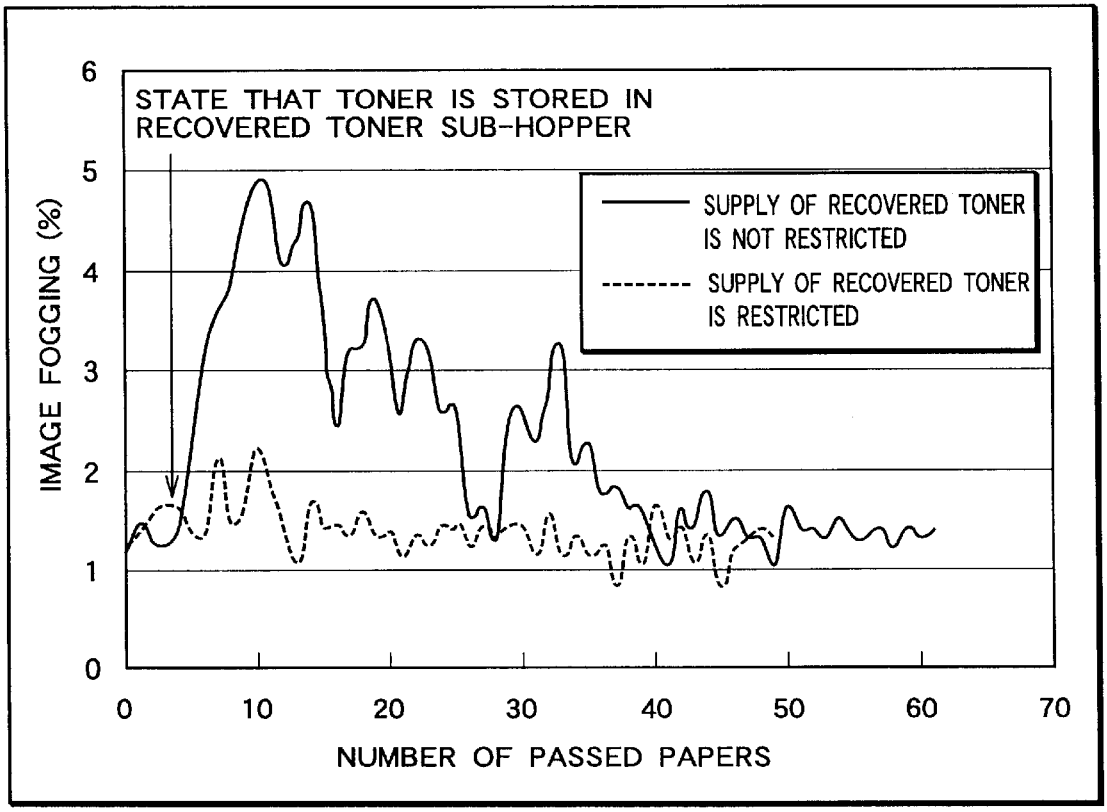
FIG. 10 is a graph showing the difference in image fogging when the control shown in FIG. 9 is carried out and when it is not carried out.

FIG. 10 is a graph showing the rates of occurrence of image fogging when the recovered toner supply control in the above described preferred embodiment is carried out after a large amount of recovered toner is stored in the recovered toner sub-hopper 42 by the opening and closing of the body cover (solid line) and when the conventional recovered toner supply control is carried out (broken line).

As can be clearly seen from FIG. 10, when the recovered toner supply control in the above described preferred embodiment is carried out, the ratio of the new toner to recovered toner to be supplied to the developing device 5 can be always substantially constant, so that it is possible to carry out stable image formation having no image fogging and so forth which are caused when the ratio of the amount of the supplied recovered toner is large.

While a method for coping with the amount of excessive recovered toner stored in the recovered toner sub-hopper 42 during the opening and closing of the body cover has been described above, the same method is applied in this preferred embodiment even if the recovered toner is excessively stored in the recovered toner sub-hopper 47 due to other causes.

That is, after the auto toner adjustment is completed, the amount of recovered toner to be supplied is decreased to be less than that during usual operations. Furthermore, in this preferred embodiment, the recovered toner is not supplied during the auto toner adjustment.

Figure 11:
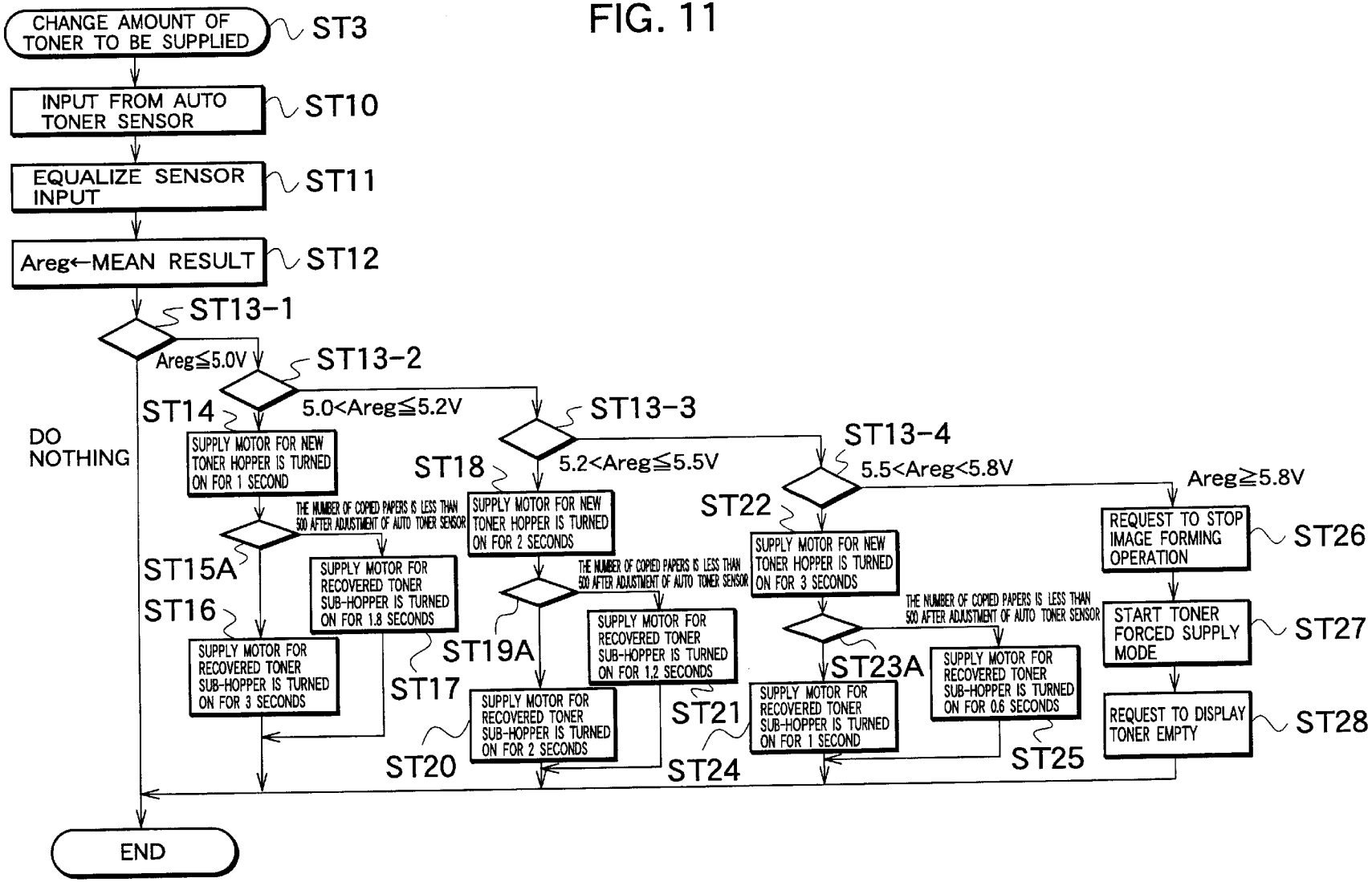
FIG. 11 is a flow chart showing a toner supply amount changing control process in FIG. 8, with respect to the process after the adjustment of an auto toner sensor is completed when a developer is exchanged.

FIG. 11 is a flow chart showing the details of the above described toner supply amount changing control process at step ST3, from the standpoint of the auto toner adjustment. In this figure, the same or corresponding reference numbers are given to the same or corresponding steps as or to those in FIG. 9.

After the auto toner adjustment is completed, if the concentration of toner is lower than the reference concentration to require to supply toner, it is determined whether the number of image forming operations is 500 or more (ST15A, ST19A, ST23A). Until the number of image forming operations reaches 500 or more, the amount of recovered toner to be supplied is suppressed to be 0.6 times (ST17, ST21, ST25) as large as that during usual operations (ST16, ST20, ST24).

The reasons why the above described adjustment of the amount of recovered toner to be supplied is carried out during the exchange of the developer will be described below.

During the exchange of the developer, it is required to adjust the auto toner sensor (developer toner specific concentration sensor) 11 which is provided in the developing device 5. That is, during the exchange of the developer, it is required to initialize the output of the auto toner sensor 11 indicative of the reference concentration (the initialized value is 5.0 V in FIGS. 9 and 11).

In the case of conventional systems wherein the recovered toner recovered by the cleaner part 7 is returned directly to the developing device 5 by means of the recovered toner connecting/conveying auger 41, it is also required to drive the photosensitive drum 2 during the driving of the developing device 5, and it is also required to rotate the connecting/conveying auger 41 and so forth. Therefore, conventionally, there is a disadvantage in that the recovered toner stored in the cleaner part 7 and connecting/conveying auger 41 enters the developing device during adjustment.

If the recovered toner enters the developing device 5 before or during the adjustment of the auto toner sensor 11 after a new developer is put in, the normal toner specific concentration is changed to a toner specific concentration to which the recovered toner is added, and this state is stored as the reference concentration during adjustment, so that an image forming operation is carried out at a toner specific concentration different from the normal toner specific concentration after the adjustment.

Therefore, in this preferred embodiment, during the adjustment of the auto toner sensor 11 during the exchange of the developer, although the recovered toner on the cleaner part 7 and connecting/conveying auger 41 is conveyed to the recovered toner sub-hopper 42, the supply auger 51 from the recovered toner sub-hopper 42 to the developing device 5 is not rotated.

Thus, the conventional variation in developer toner specific concentration during the adjustment of the auto toner sensor 11 does not occur, so that it is possible to carry out precise adjustment.

However, since the recovered toner is also additionally stored in the recovered toner sub-hopper 42 during the adjustment of the auto toner sensor 11, the same problems as the above described problems (conventional problems) immediately after the opening and closing of the body cover are caused unless the amount of recovered toner to be supplied is controlled.

Therefore, in this preferred embodiment, in order to hold the amount of recovered toner to be supplied, which is equal to that during usual operations (ST16, ST20, ST24 in FIG. 11), even if a large amount of recovered toner is additionally stored in the recovered toner sub-hopper 42 during the adjustment of the auto toner sensor 11, the amount of recovered toner to be supplied from the recovered toner sub-hopper 42 to the developing device 5 is set to be 60% of that during usual operations (ST17, ST21, ST25) until 500 image forming operations are carried out after the adjustment.

Specifically, until 500 image forming operations are completed immediately after the control part 70 recognizes that the toner specific concentration auto adjustment mode is completed, the rotating time of the supply auger 51 in the recovered toner sub-hopper 42 is set to be 0.6 times as long as that during usual operations.

Also in this setting, the rotating time of the supply auger 51 in the recovered toner sub-hopper 42, and the number of image forming operations (the number of copied papers or the number of passed papers) for suppressing the amount of recovered toner to be supplied, may be set on the basis of the amount of recovered toner conveyed to the recovered toner sub-hopper 42 during the adjustment, the conveying capacity from the recovered toner sub-hopper 42, and the time required to substantially discharge the recovered toner stored in the recovered toner sub-hopper 42 during the adjustment.

Furthermore, the above described graph in FIG. 10 can be also regarded as a graph showing the relationship between this preferred embodiment and the prior art after a large amount of recovered toner is stored in the recovered toner sub-hopper 42 after the adjustment of the toner specific concentration sensor.

As described above, the supply of the recovered toner to the developing device 5 is stopped during the adjustment of the auto toner sensor 11, and the supply of the recovered toner is restricted in a predetermined number of image forming operations after the adjustment of the auto toner sensor 11. Therefore, the ratio of the new toner to recovered toner to be supplied to the developing device 5 can be always substantially constant, so that it is possible to carry out stable image formation having no image fogging and so forth which are caused when the ratio of the amount of the supplied recovered toner is large.

In the above described preferred embodiment, the supply of the recovered toner has been restricted after the opening and closing of the body cover (front cover). However, a vibration detecting sensor may be provided in the vicinity of the recovered toner connecting/conveying auger 41 or the like, and the supply of the recovered toner may be restricted a predetermined number after the vibration detecting sensor detects such a vibration level or more that the recovered toner adhering to the recovered toner connecting/conveying auger 41 and so forth is peeled off.

In the above described preferred embodiment, the supply of the recovered toner has been restricted regardless of the size of papers used for image formation. However, the amount of recovered toner to be supplied to be restricted may be changed in accordance with the size of papers used for image formation.

In the above described preferred embodiment, there has been a single stage that the amount of the recovered toner to be supplied is restricted after the occurrence of a predetermined event in which the stored recovered toner is increased. However, there may be a plurality of restricting stages. For example, after the occurrence of a predetermined event, the amount of recovered toner to be supplied until 250 image forming operations may be 0.6 times as large as that during usual operations, the amount of recovered toner to be supplied between 250 and 500 image forming operations may be 0.8 times as large as that during usual operations, and the amount of recovered toner to be supplied after 500 image forming operations may be returned to that during usual operations. In addition, a recovered toner supply stopping stage (the supply of only new toner) may be provided as a restricting stage.

In the above described preferred embodiment, the period of time required to decrease the amount of recovered toner to be supplied or stop the supply of recovered toner has been defined by the number of image forming operations (the number of copying operations). However, the period of time required to decrease the amount of recovered toner to be supplied or stop the supply of recovered toner may be defined by other methods. For example, a probable rate of black prescribed in accordance with a paper size may be prescribed to accumulate the probable rate of black prescribed in accordance with the paper size every image forming operation, and the amount of recovered toner to be supplied may be less than that during usual operations or the supply of recovered toner may be stopped until the accumulated value reaches a predetermined threshold.

In the above described preferred embodiment, the new toner supply construction has not been a cartridge construction. However, the present invention can be applied to a case where the new toner supply construction is a cartridge construction.

The image forming apparatus and method according to the present invention can not only be applied to copying machines, but they can be also applied to other apparatuses, such as printers and facsimiles, which use a photosensitive drum for carrying out image formation.

What is claimed is:

1. An image forming apparatus comprising:

recovered toner housing means for temporarily storing therein a recovered toner;

a connecting/conveying device for conveying said recovered toner from a cleaner part to said recovered toner housing means;

recovered toner supply means for supplying said recovered toner, which is housed in said recovered toner housing means, to a developing device;

new toner housing means for housing therein a new toner;

new toner supply means for supplying said new toner, which is stored in said new toner housing means, to said developing device;

toner concentration ratio detecting means for detecting a toner concentration ratio in said developing device; and control means for controlling said recovered toner supply means and said new toner supply means, in accordance with the contents detected by said toner concentration ratio detecting means, to supply said recovered toner and new toner to said developing device, wherein said control means causes the amount of said recovered toner to be supplied to be less than the amount of said recovered toner during a usual operation, which is determined in accordance with the contents detected by said toner concentration ratio detecting means, or stops the supply of said recovered toner, while a predetermined period condition is satisfied after the occurrence of a predetermined event in which the amount of said recovered toner stored in said recovered toner housing means is temporarily excessive, and wherein said control means recognizes a period of time required to cause the amount of said recovered toner to be supplied to be less than the amount of said recovered toner to be supplied during the usual operation or to stop the supply of said recovered toner, on the basis of the number of image forming operations after the occurrence of said predetermined event.

2. An image forming apparatus comprising:

recovered toner housing means for temporarily storing therein a recovered toner;

a connecting/conveying device for conveying said recovered toner from a cleaner part to said recovered toner housing means;

recovered toner supply means for supplying said recovered toner, which is housed in said recovered toner housing means, to a developing device;

new toner housing means for housing therein a new toner;

new toner supply means for supplying said new toner, which is stored in said new toner housing means, to said developing device;

toner concentration ratio detecting means for detecting a toner concentration ratio in said developing device; and control means for controlling said recovered toner supply means and said new toner supply means, in accordance with the contents detected by said toner concentration ratio detecting means, to supply said recovered toner and new toner to said developing device, wherein said control means causes the amount of said recovered toner to be supplied to be less than the amount of said recovered toner during a usual operation, which is determined in accordance with the contents detected by said toner concentration ratio detecting means, or stops the supply of said recovered toner, while a predetermined period condition is satisfied after the occurrence of a predetermined event in which the amount of said recovered toner stored in said recovered toner housing means is temporarily excessive, and wherein said predetermined event serving as a trigger for causing the amount of said recovered toner to be supplied to be less than the amount of said recovered toner to be supplied during the usual operation or for stopping the supply of said recovered toner is the opening and closing of a body cover of a system in which said image forming apparatus is provided.

3. An image forming method comprising:

causing a connecting/conveying device to convey a recovered toner from a cleaner part to a recovered toner housing means to house the recovered toner;

detecting a toner concentration ratio in a developing device with a toner concentration ratio detecting means; and causing a control means to control recovered toner supply means and new toner supply means, in accordance with the detected toner concentration ratio, to supply the recovered toner stored in the recovered toner housing means and new toner stored in new toner housing means to the developing device, wherein the control means causes the amount of the recovered toner to be supplied to be less than the amount of the recovered toner during a usual operation, which is determined in accordance with the detected toner concentration ratio, or stops the supply of the recovered toner, while a predetermined condition is satisfied after the occurrence of a predetermined event in which the amount of the recovered toner stored in the recovered toner housing means is temporarily excessive, and wherein said control means recognizes a period of time required to cause the amount of said recovered toner to be supplied to be less than the amount of said recovered toner to be supplied during the usual operation or to stop the supply of said recovered toner, on the basis of the number of image forming operations after the occurrence of said predetermined event.

4. An image forming method comprising:

causing a connecting/conveying device to convey a recovered toner from a cleaner part to a recovered toner housing means to house the recovered toner;

detecting a toner concentration ratio in a developing device with a toner concentration ratio detecting means; and causing a control means to control recovered toner supply means and new toner supply means, in accordance with the detected toner concentration ratio, to supply the recovered toner stored in the recovered toner housing means and new toner stored in new toner housing means to the developing device, wherein the control means causes the amount of the recovered toner to be supplied to be less than the amount of the recovered toner during a usual operation, which is determined in accordance with the detected toner concentration ratio, or stops the supply of the recovered toner, while a predetermined condition is satisfied after the occurrence of a predetermined event in which the amount of the recovered stored in the recovered toner housing means is temporarily excessive, and wherein said predetermined event serving as a trigger for causing the amount of said recovered toner to be supplied to be less than the amount of said recovered toner to be supplied during the usual operation or for stopping the supply of said recovered toner is the opening and closing of a body cover of a system in which said image forming apparatus is provided.

5. An image forming apparatus comprising:

recovered toner housing means for temporarily storing therein a recovered toner;

a connecting/conveying device for conveying said recovered toner from a cleaner part to said recovered toner housing means;

recovered toner supply means for supplying said recovered toner, which is housed in said recovered toner housing means, to a developing device;

new toner housing means for housing therein a new toner;

new toner supply means for supplying said new toner, which is stored in said new toner housing means, to said developing device;

toner concentration ratio detecting means for detecting a toner concentration ratio in said developing device; and control means for controlling said recovered toner supply means and said new toner supply means, in accordance with the contents detected by said toner concentration ratio detecting means, to supply said recovered toner and new toner to said developing device, wherein said control means causes said connecting/conveying device to convey said recovered toner to said recovered toner housing means, while it stops the supply of the recovered toner from said recovered toner housing means to said developing device at an initial adjustment of said toner concentration ratio detecting means during the exchange of a developer.

6. An image forming apparatus as set forth in claim 5, wherein said control means causes the amount of said recovered toner to be supplied to be less than the amount of said recovered toner to be supplied during a usual operation, which is determined in accordance with the contents detected by said toner concentration ratio detecting means, or stops the supply of said recovered toner while a predetermined period condition is satisfied after the end of initial adjustment of said toner concentration ratio detecting means made at the time of the exchange of said developer during which the amount of said recovered toner stored in said recovered toner housing means is temporarily excessive.

7. An image forming method comprising:

causing a connecting/conveying device to convey a recovered toner from a cleaner part to a recovered toner housing means to house the recovered toner;

detecting a toner concentration ratio in a developing device with a toner concentration ratio detecting means;

causing a control means to control recovered toner supply means and new toner supply means, in accordance with the detected toner concentration ratio, to supply the recovered toner stored in the recovered toner housing means and new toner stored in new toner housing means to the developing device; and controlling the connecting/conveying device to convey the recovered toner to the recovered toner housing means while stopping the supply of the recovered toner from the recovered toner housing means to the developing device at an initial adjustment of the toner concentration ratio detecting means during the exchange of a developer.

8. An image forming method as set forth in claim 7, wherein said control means causes the amount of said recovered toner to be supplied to be less than the amount of said recovered toner to be supplied during a usual operation, which is determined in accordance with the contents detected by said toner concentration ratio detecting means, or stops the supply of said recovered toner while a predetermined period condition is satisfied after the end of initial adjustment of said toner concentration ratio detecting means made at the time of the exchange of said developer during which the amount of said recovered toner stored in said recovered toner housing means is temporarily excessive.

* * * * *

UNITED STATES PATENT AND TRADEMARK OFFICE

CERTIFICATE OF CORRECTION

PATENT NO. : 6,603,949 B2 
DATED : August 5, 2003
INVENTOR(S) : Shinichi Itoh et al.

It is certified that error appears in the above-identified patent and that said Letters Patent is hereby corrected as shown below:

Column 16,
Line 14, after "the recovered", insert -- toner --.

Signed and Sealed this

Thirtieth Day of December, 2003

JAMES E. ROGAN
*Director of the United States Patent and Trademark Office*